US011291322B2

(12) United States Patent
Jones

(10) Patent No.: US 11,291,322 B2
(45) Date of Patent: Apr. 5, 2022

(54) HOODED GARMENT HOOK

(71) Applicant: Pam A. Jones, Cleveland, OH (US)

(72) Inventor: Pam A. Jones, Cleveland, OH (US)

( * ) Notice: Subject to any disclaimer, the term of this patent is extended or adjusted under 35 U.S.C. 154(b) by 99 days.

(21) Appl. No.: 15/605,459

(22) Filed: May 25, 2017

(65) Prior Publication Data

US 2017/0340154 A1 Nov. 30, 2017

Related U.S. Application Data

(60) Provisional application No. 62/342,291, filed on May 27, 2016.

(51) Int. Cl.
*A47G 25/06* (2006.01)

(52) U.S. Cl.
CPC ..... *A47G 25/0614* (2013.01); *A47G 25/06* (2013.01)

(58) Field of Classification Search
CPC . A47G 25/06; A47G 25/0607; A47G 25/0614
USPC ..... D6/320, 327, 323, 325, 316, 314; 211/85.2, 85.3; 223/88, 87, DIG. 4
See application file for complete search history.

(56) References Cited

U.S. PATENT DOCUMENTS 1,294,916 A * 2/1919 Knight ..... A47B 96/061 211/103
1,760,290 A * 5/1930 Tammarazzo ..... A47G 25/0614 211/103
D287,816 S * 1/1987 Chasen ..... 248/205.3
D289,255 S * 4/1987 Chasen ..... D6/323
D294,791 S * 3/1988 Loscalzo ..... D6/323
D294,792 S * 3/1988 Zimmerman ..... D6/323
D306,385 S * 3/1990 Alexander ..... D6/552
5,503,310 A * 4/1996 Zuckerman ..... A47G 25/1421 223/85
6,223,914 B1 * 5/2001 Snell ..... A47G 25/06 211/117
D641,230 S * 7/2011 Goodman ..... D8/367
D660,602 S * 5/2012 Appell ..... D6/316
D665,653 S * 8/2012 Thompson ..... D8/367
D679,578 S * 4/2013 Gilboe ..... D6/569
D751,372 S * 3/2016 Thompson ..... D8/372
2003/0085331 A1 * 5/2003 Week ..... A47G 1/20 248/475.1
2012/0181244 A1 * 7/2012 Wang ..... A47G 25/06 211/106.01
2013/0299527 A1 * 11/2013 Mazyck ..... A47G 25/16 223/88
2015/0289685 A1 * 10/2015 Kressin ..... A47G 1/1653 248/477

OTHER PUBLICATIONS

Circa 2015, Basketball Coat Rack, Bed Bath & Beyond Web Page, 1 page.

* cited by examiner

*Primary Examiner* — Nathan E Durham
(74) *Attorney, Agent, or Firm* — Fay Sharpe LLP

(57) ABSTRACT

A hook assembly for hanging hoodies and garments has a body including a plurality of hooks extending from the body thereby forming openings in the body. The hooks form cup-shaped portions for receiving a garment. The hooks and the body are configured to resemble balls or other items. One or more mounting arms are mounted to a rear portion of the body.

14 Claims, 14 Drawing Sheets

HOODED GARMENT HOOK

CLAIM OF PRIORITY

This application claims priority from Provisional Application Ser. No. 62/342,291, filed May 27, 2016, the entirety of which is hereby incorporated by reference herein.

BACKGROUND OF THE DISCLOSURE

The present disclosure relates to a garment hook, especially a garment hook for use with hooded garments or jackets known as hoodies, sweatshirts, coats, jackets, shirts, or other garments in which a series of hooks are mounted to a member which is attached to a wall or hung on a door. More particularly, the disclosure relates to a garment hook which can have one or more extendable mounting members and a main body on which a plurality of hooks are mounted.

Garment hooks of the type mentioned are widely used for sportswear, sweatshirts, hoodies, and other garments.

Garment hooks can be frequently bulky, insufficiently strong, unsightly, and occupy a lot of space on a wall or door.

It is a principal object of the present disclosure to provide fasteners, e.g. garment hooks, especially for hoodies or sweatshirts, whereby the drawbacks mentioned previously are obviated and the hooks are sturdy and positioned in a compact arrangement.

Another object of the disclosure is to provide a garment hook for the purposes described which can be easily mounted to and removed from a wall or the back of a door.

Other aspects of the disclosure will become apparent upon reading and understanding the following detailed description.

SUMMARY OF THE DISCLOSURE

The present disclosure relates to a garment hook, especially a garment hook for use with hooded jackets or hoodies, sweatshirts, coats, jackets, shirts, T-shirts, or other garments in which a series of hooks are mounted to a member which is attached to a wall or hung on a door.

In accordance with one embodiment of the disclosure, the hook assembly includes a mounting arm or clip, and a body or board to which a plurality of hooks are mounted.

In accordance with a preferred embodiment of the disclosure, a hook assembly for hanging hoodies and garments has a body having a plurality of hooks extending from the body thereby forming openings in the body, wherein the hooks form a cup-shaped portion for receiving a garment such as a hoodie and at least one mounting arm is mounted to a rear portion of the body.

In accordance with another embodiment of the disclosure, the body or board and hooks can be formed of one piece. The board and hooks can be made a variety of suitable materials, such as metal, plastic, wood, cardboard, etc.

In accordance with another embodiment of the disclosure, a pair of mounting arms can be attached to the hook board.

In accordance with another embodiment of the disclosure, a garment hook arrangement has one or more holes in the back of the mounting board to hang the hook assembly on a wall or door or a nail.

In accordance with another aspect of the disclosure, the clip has an elongated member having a C-shaped or U-shaped hook at a top or distal end thereof. The hook is used to mount the assembly on and over an upper end of a door. Alternatively, the clip can be used in a retracted position within a slot formed in the wall behind the board and mounted to a wall within a room such as a bedroom.

In accordance with another embodiment of the disclosure, the hook board has a pair of openings for receiving the mounting arms or nails on a wall.

In accordance with another embodiment of the disclosure, each of the mounting arms has one or more mounting pegs for attaching the hook aboard.

In accordance with another embodiment of the disclosure, the board has an aesthetic appearance and can be in the configuration of a basketball, but other configurations, such as a baseball, football, soccer ball, tennis ball, etc. can also be used. The board can be made of plastic, wood, sturdy cardboard or any durable material.

In accordance with another embodiment of the disclosure, five hooks are used, but other numbers and orientations are contemplated by the disclosure. The hook can be evenly spaced apart around a perimeter of board. The hooks can be made of metal, plastic, wood or any durable material.

In accordance with another embodiment of the disclosure, the hooks can be of a variety of shapes, such as round, oval, square, semi-circles, or even have the appearance of a ball, such as a basketball, baseball, etc.

In accordance with another embodiment of the disclosure, the board and hooks can be in a basketball theme, but many other themes can be used, such as other sports, kids characters, ladybugs, butterflies, selfies, jewel-encrusted ("bling"), etc.

Still further aspects of the disclosure will be seen and understood upon a reading of the following detailed description.

DETAILED DESCRIPTION OF THE DISCLOSURE

The present disclosure relates to a garment hook, especially a garment hook for use with hoodies, sweatshirts, or other garments in which a series of hooks are mounted to a member which is attached to a wall or hung on a door. More particularly, the disclosure relates to a garment hook which has one or more mounting members and a main body on which a plurality of hooks are mounted.

Garment hooks of the type mentioned are widely used for sportswear, sweatshirts, hoodies, and other garments.

A principal object of the disclosure is to provide a garment hook for the purposes described which can be easily mounted to and removed from a wall or the back of a door.

In FIGS. 1-6 of the drawings are shown a preferred embodiment of the garment hook of the disclosure.

Figure 1:
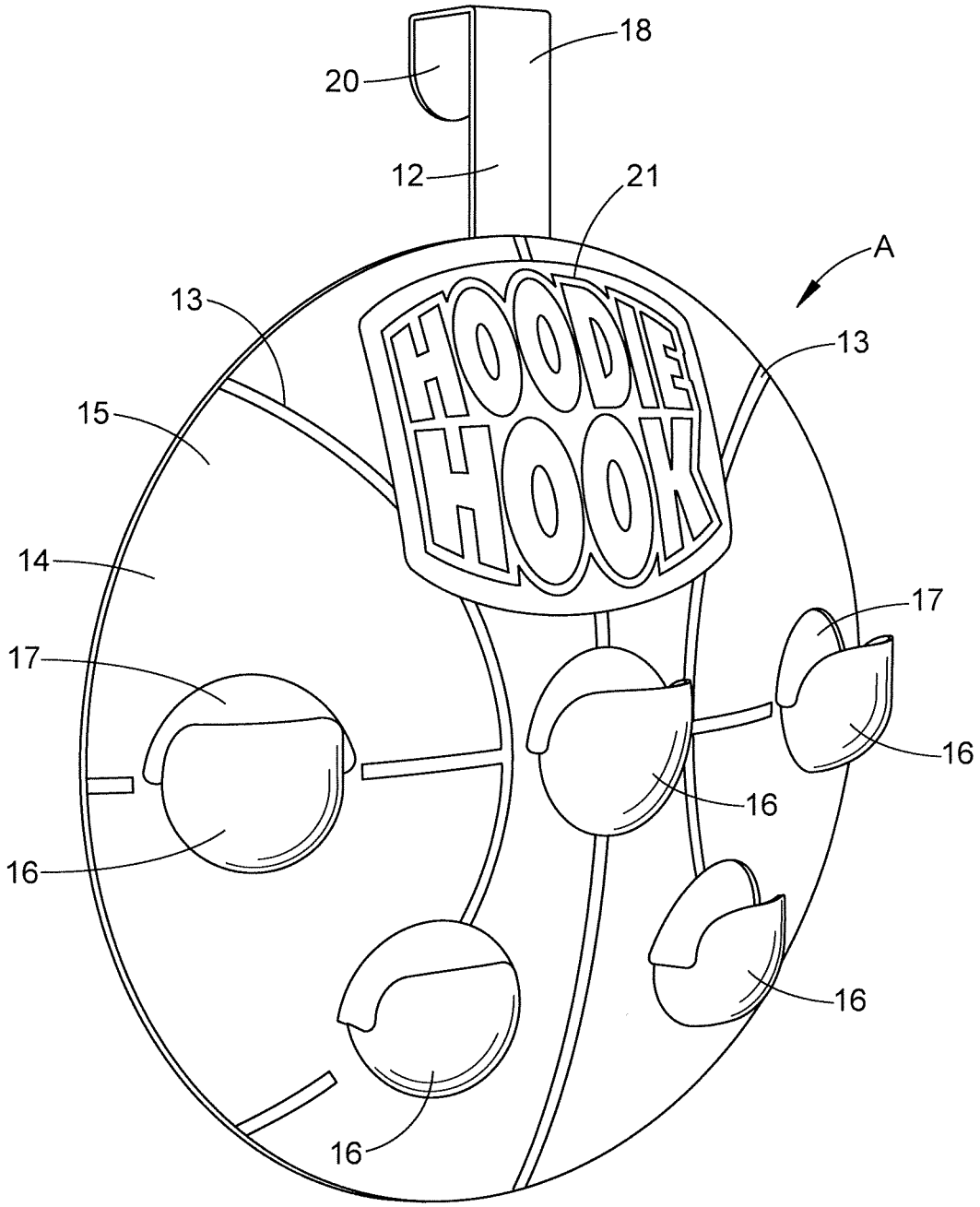
FIG. 1 is a front perspective view of a garment hook according a preferred embodiment of the disclosure.

FIG. 1 shows a hoodie or garment hook assembly A in accordance with the preferred embodiment. The assembly includes a retractable mounting arm or clip 12, and a body or board 14 to which a plurality of hooks 16 are integrally formed or mounted. The body or board and hooks 16 can be preferably formed of one piece. The hooks 16 extend from and protrude outwardly from the board thereby forming openings or cavities 17. The board and hooks can be made a variety of suitable materials, such as metal, plastic, wood, cardboard, etc.

The board 14 in FIG. 1 is configured to have the appearance of a basketball. The front wall 15 of the board can be textured to simulate the appearance of a basketball. Front wall 15 can be flat or of an arcuate shape or curved outwardly to form a rounded and 3D appearance much like the front of a ball such as a basketball, baseball, soccer ball or football. Also, there can be grooves or stickers 13 formed on the front wall 15 to further duplicate the appearance of a basketball (or baseball, soccer ball, etc.). The hooks 16 themselves can be configured to look like partial portions of basketballs or other balls which form a cup-like shape which protrudes outwardly from first wall 15 to hold the hoodie or garment. That is, each of the hooks 16 forms a cavity 17 or opening in the board 14 which receives the garment. Also, a decal or label 21 can be integrally formed into wall 15 or added onto wall 15 such as to show the name "Hoodie Hook"™ for the hanger.

Figure 2:
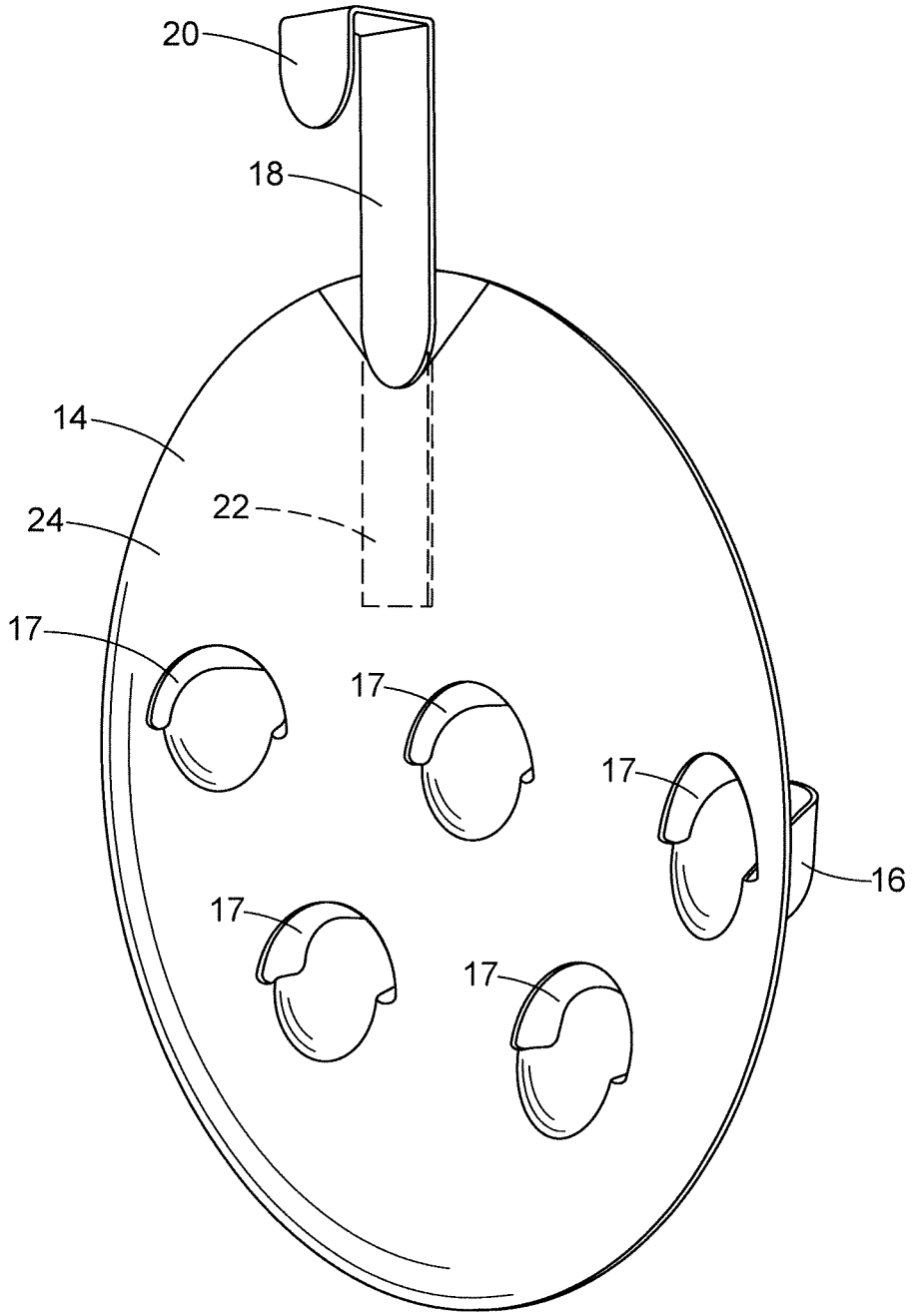
FIG. 2 is a rear perspective view of the garment hook of FIG. 1.
Figure 4:
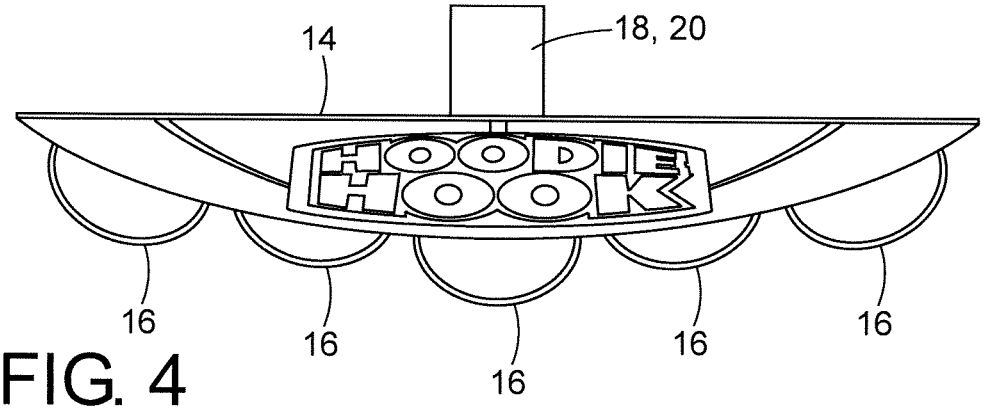
FIG. 4 is a top plan view of FIG. 1.
Figure 3:
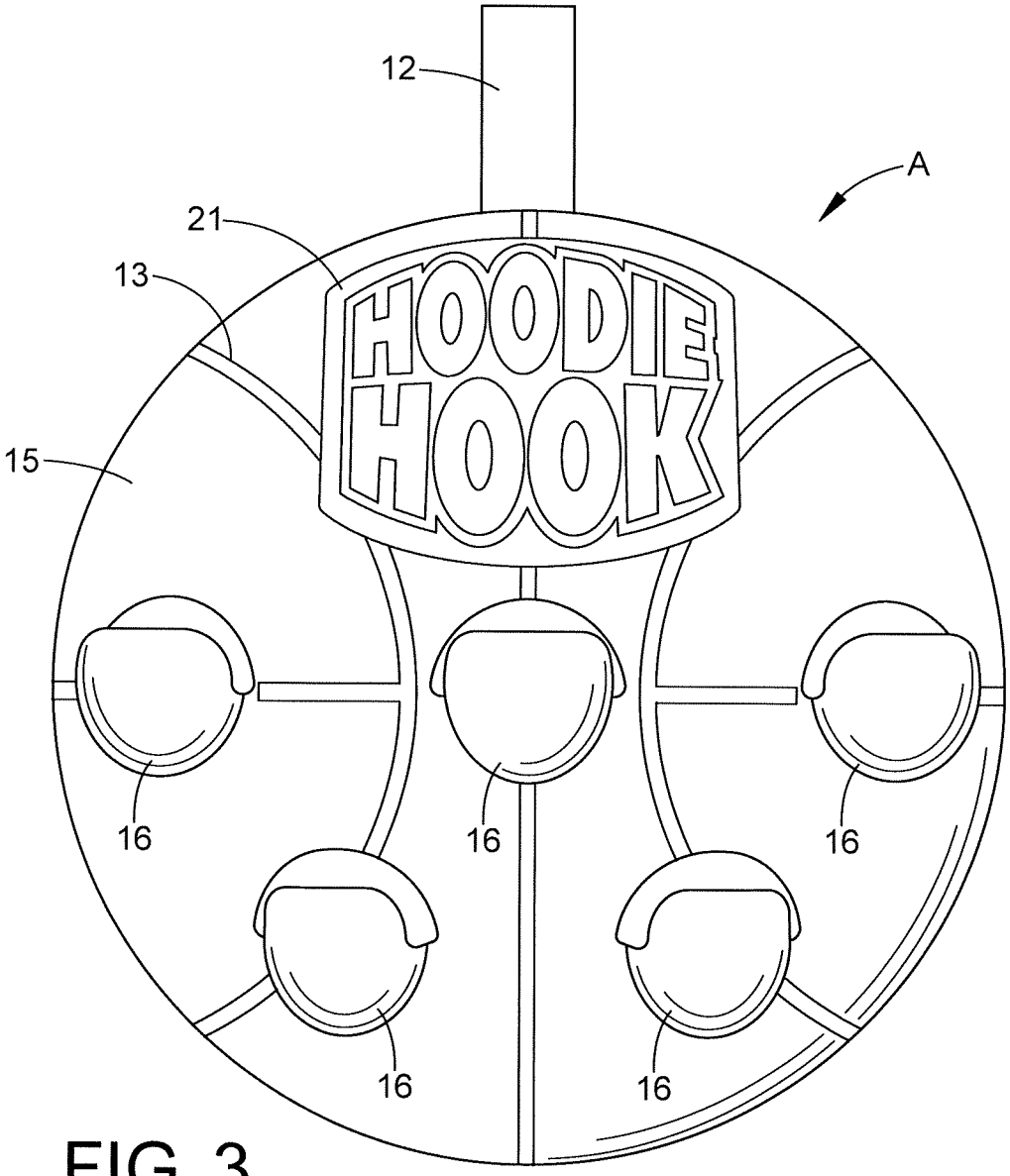
FIG. 3 is a front elevational view of the hook of FIG. 1.
Figure 5:
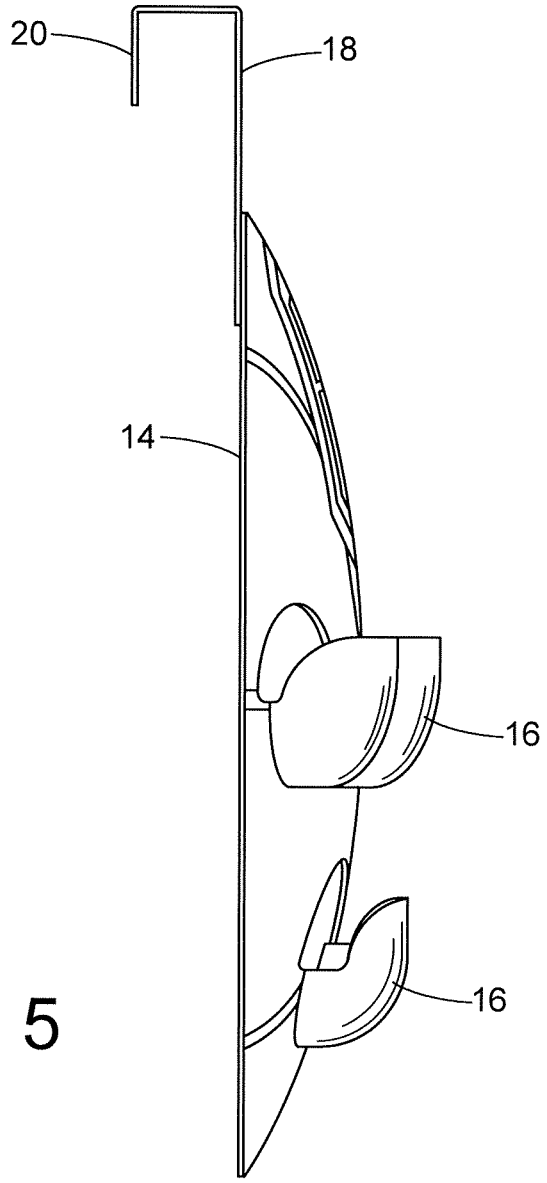
FIG. 5 is a left side elevational view of the hook of FIG. 1.
Figure 6:
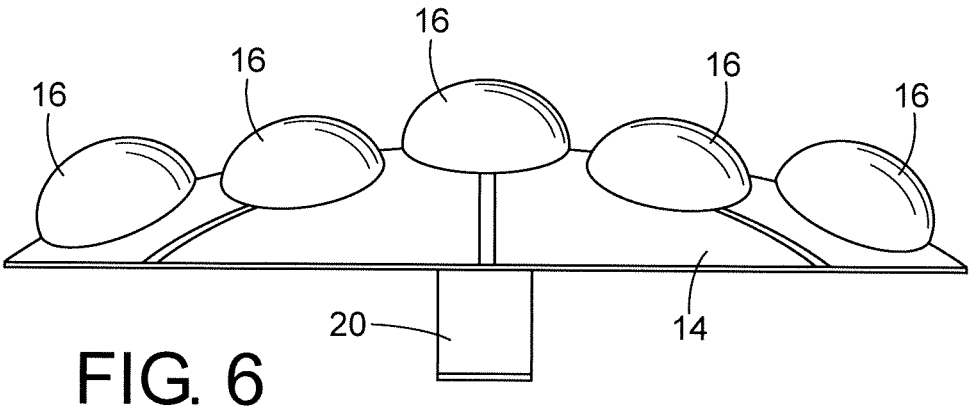
FIG. 6 is a bottom plan view of the hook of FIG. 1.

Referring to FIG. 2, clip or arm 12 has an elongated member 18 having an inverted C-shaped or U-shaped hook 20 at a top or distal end thereof. Hook 20 is used to mount the assembly on an upper end of a wall or door (not shown). That is, the hook extends over the top wall of a door. Arm 12 is inserted and locked (such as by teeth or friction) within a slot 22 formed in wall 24 behind the board 14 and mounted to a wall within a room such as a bedroom. The arm may be inserted and moved into the slot lower for a lower mounting position or higher for a higher mounting position.

As previously discussed, board 14 has a circular outer perimeter and is shown in the configuration of a basketball, but other configurations, such as a baseball, football, soccer ball, tennis ball, flower, globe, etc. can also be used. The hooks 16 are preferably evenly spaced about front wall 15 of board 14. The board can be made of plastic, wood, sturdy cardboard or any durable material.

There is shown to be five hooks 16, but other numbers and orientations are contemplated by the disclosure. The hook can be evenly or unevenly spaced apart around a perimeter of board 14. The hooks can be made of metal, plastic, wood or any durable material. The hooks 16 can be of a variety of shapes, such as round, oval, square, semi-circles, or even have the appearance of a ball, such as a basketball, baseball, etc.

The board and hooks are shown in a basketball theme, but many other themes can be used, such as other sports, kids characters, ladybugs, butterflies, selfies, bling, etc.

Referring now to FIGS. 7-13, a garment hook in accordance with another embodiment of the disclosure is shown.

Figure 7:
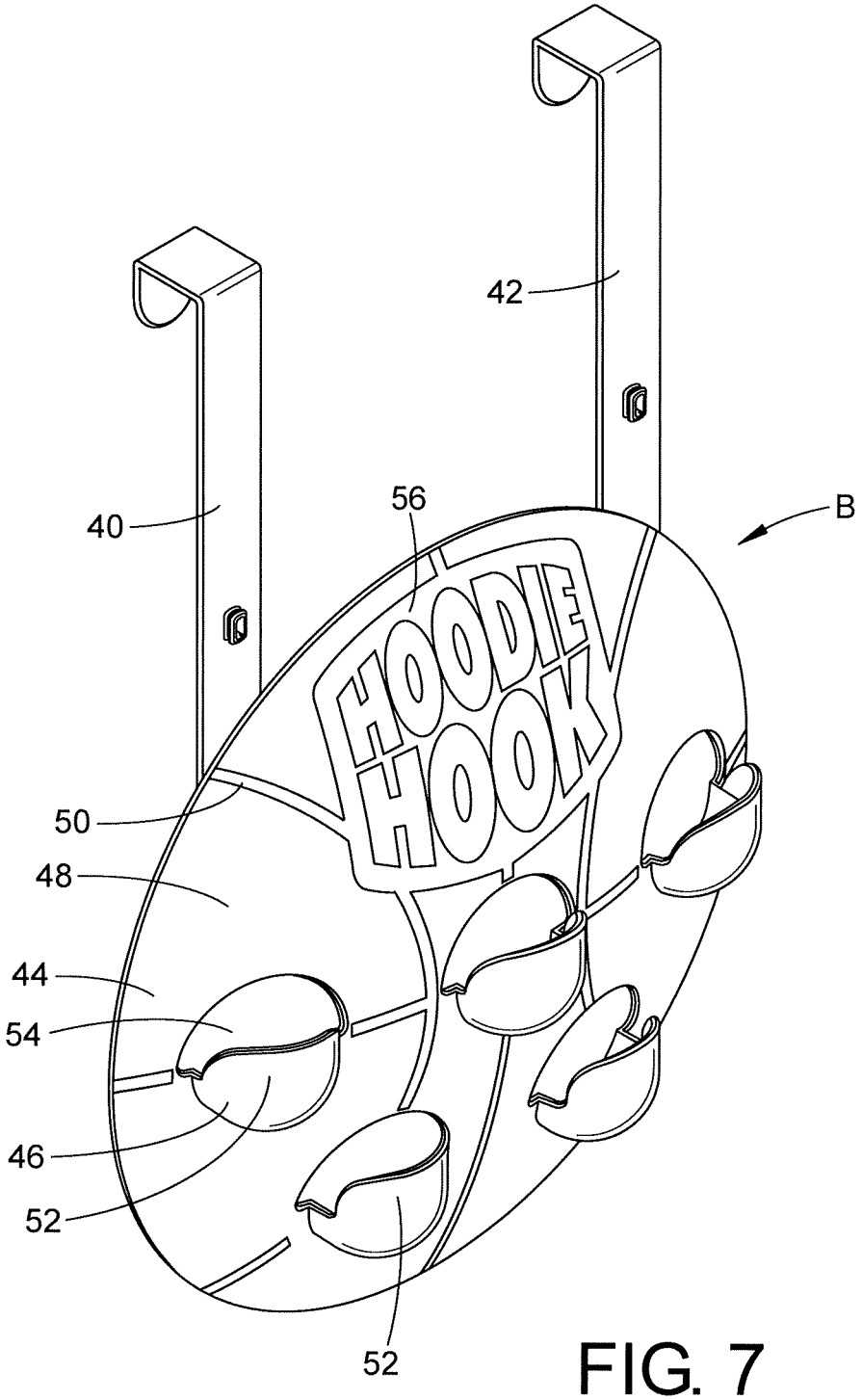
FIG. 7 is a perspective view of a garment hook in accordance with another embodiment of the disclosure.
Figure 8:
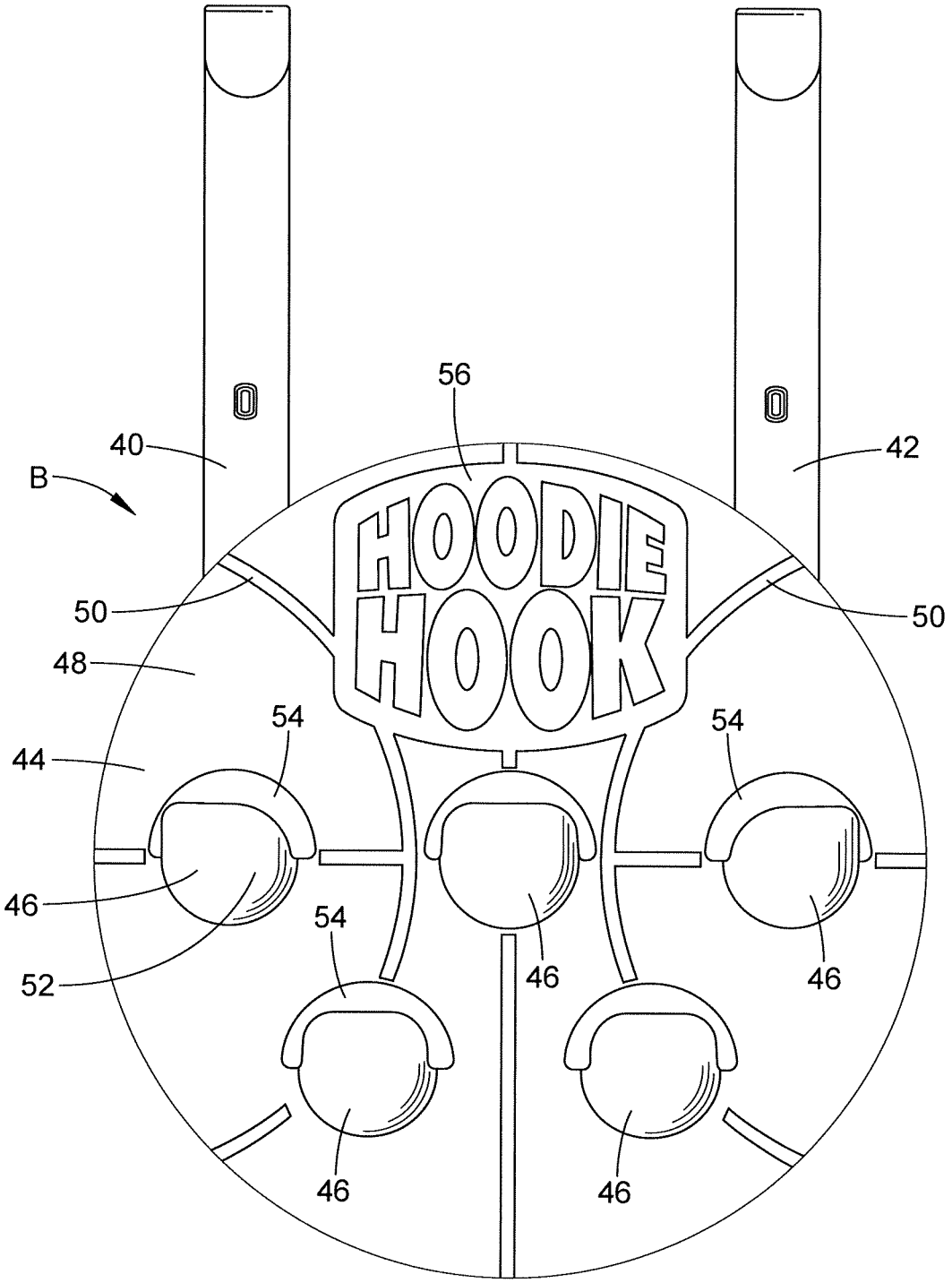
FIG. 8 is a front elevational view of the garment hook of FIG. 7.

FIGS. 7 and 8 shows a hoodie or garment hook assembly B in accordance with another preferred embodiment of the disclosure. The assembly includes a pair of spaced apart mounting arms 40, 42, and a body or board 44 to which a plurality of hooks 46 are integrally formed or mounted. The body or board 44 and hooks 46 can be preferably formed of one piece. The board and hooks can be made a variety of suitable materials, such as metal, plastic, wood, sturdy cardboard, etc.

There is shown to be five hooks 46, but other numbers and orientations are contemplated by the disclosure. The hook can be evenly spaced apart around a perimeter of board 44. The hooks can be made of metal, plastic, wood or any durable material. The hooks 46 can be of a variety of shapes, such as round, oval, square, semi-circles, or even have the appearance of a ball, such as a basketball, baseball, etc.

The board 44 in FIG. 7 is also configured to have the appearance of a basketball. The front wall 48 of the board can be textured to simulate the appearance of a basketball. Front wall 48 can be flat or of an arcuate shape or curved outwardly to form a rounded and 3D appearance much like the front of a ball. Also, there can be grooves or stickers 50 formed or placed on the front wall to further duplicate the appearance of a basketball (or baseball, soccer ball, etc.). The hooks 46 themselves can be configured to look like partial portions of basketballs or other balls which form a cup-like shape to hold the hoodie or garment. That is, the hooks 46 have outwardly curved or rounded front walls 52 which form cavities 54 or openings in the board which receive the garment(s). Also, a decal or label 56 can be integrally formed into wall 46 or added onto the wall such as to show the name "Hoodie Hook"™ for the hanger.

Figure 9:
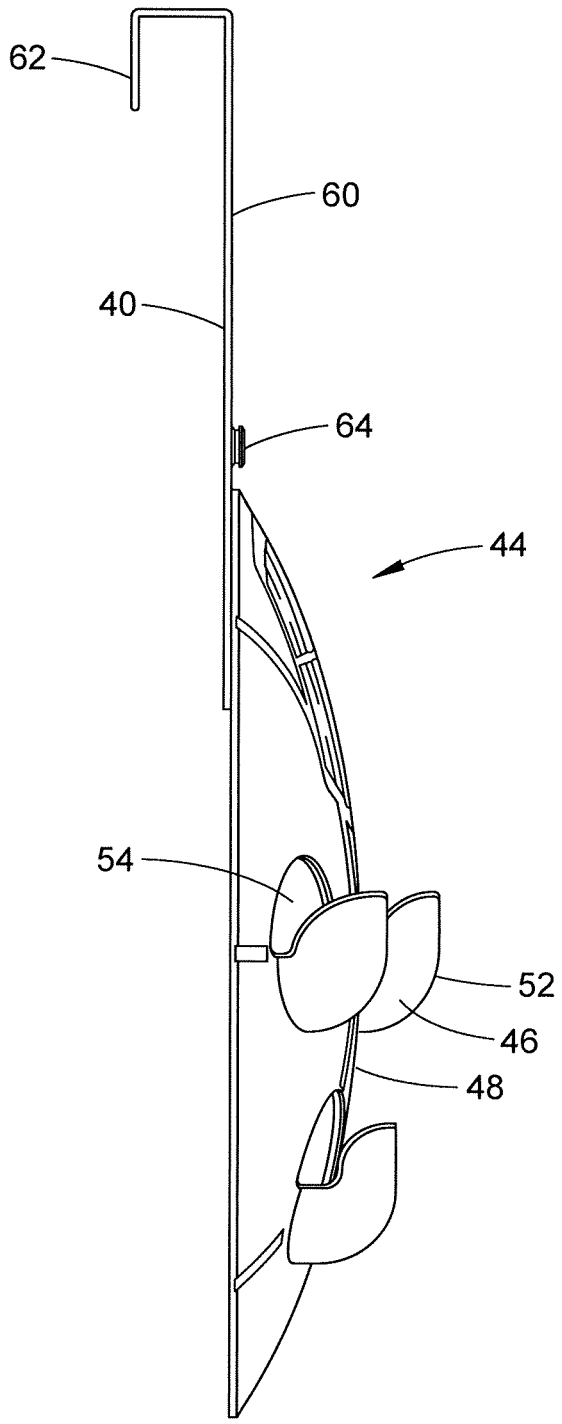
FIG. 9 is a side elevated view of the garment hook of FIG. 7.
Figure 10:
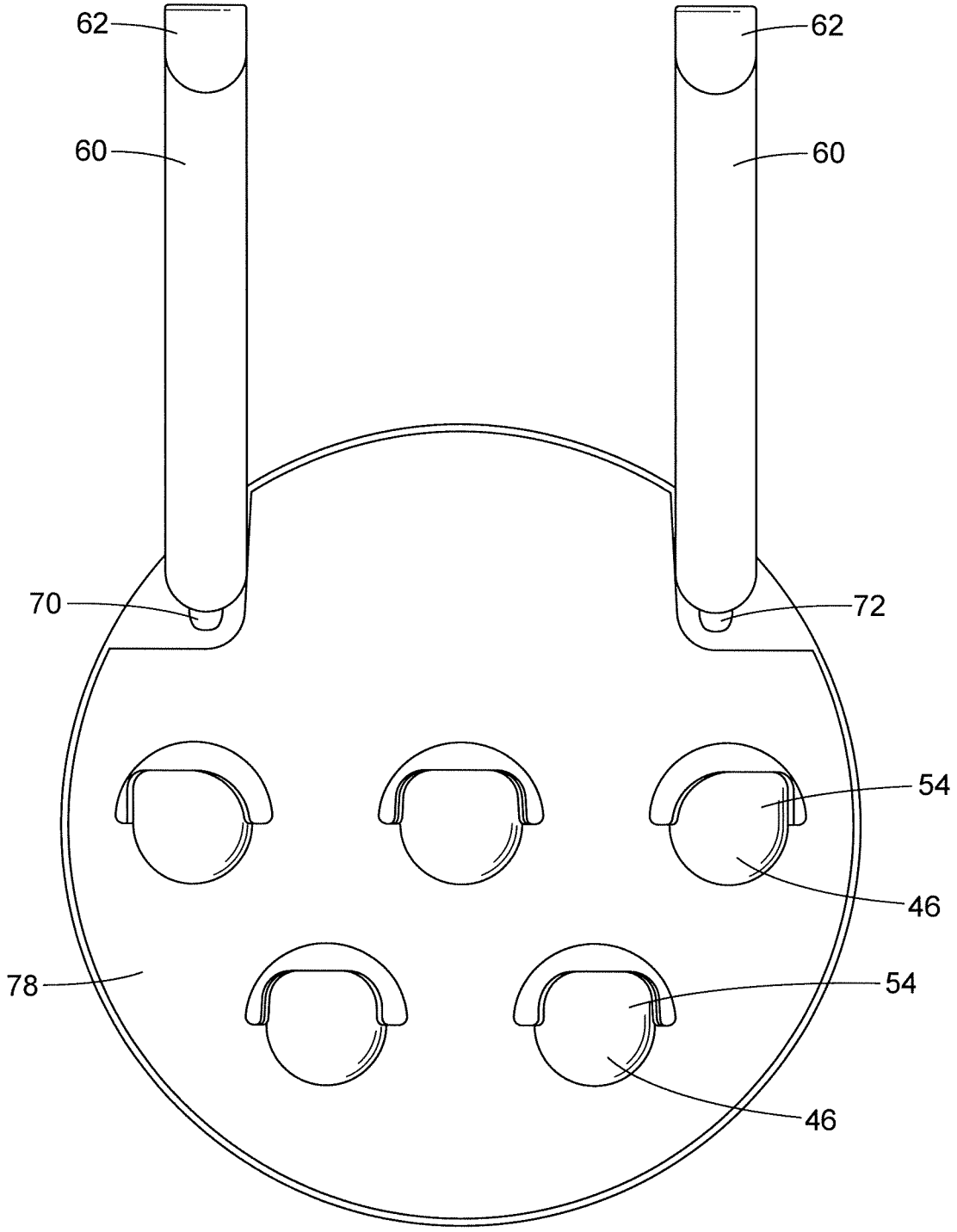
FIG. 10 is a rear elevated view of the garment hook of FIG. 7.
Figure 11:
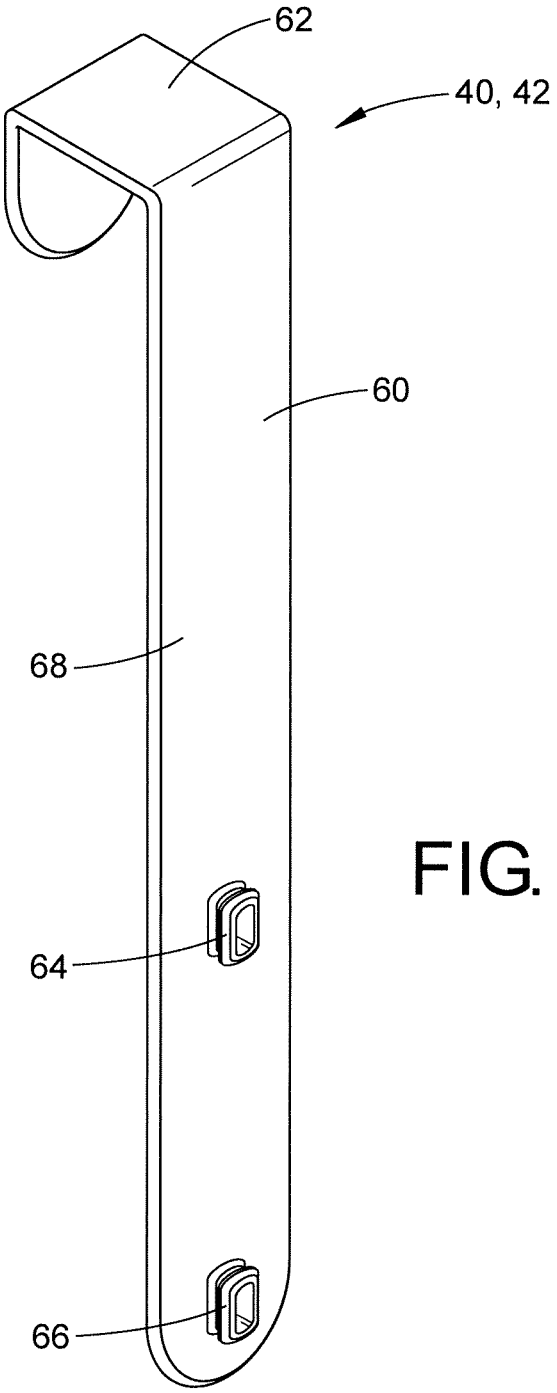
FIG. 11 is a perspective view of a mounting arm in accordance with another embodiment of the disclosure.

Referring to FIGS. 9, 10, and 11, clips or arms 40, 42 each has an elongated member 60 having an inverted C-shaped or U-shaped hook 62 at a top or distal end thereof. Hooks 62 of arms 40 and 42 are used to mount the assembly on an upper end of a door or wall (not shown). That is, the hooks extend over the top wall of a door. Referring to FIG. 11, there are two upper and lower mounting pegs 64, 66 on a front wall 68 of the elongated member 60. The height adjustment pegs are spaced apart. The lower peg 66 is used for children by positioning the board 44 lower, while the higher peg 64 is used for adults by positioning the board 44 higher.

Figure 12:
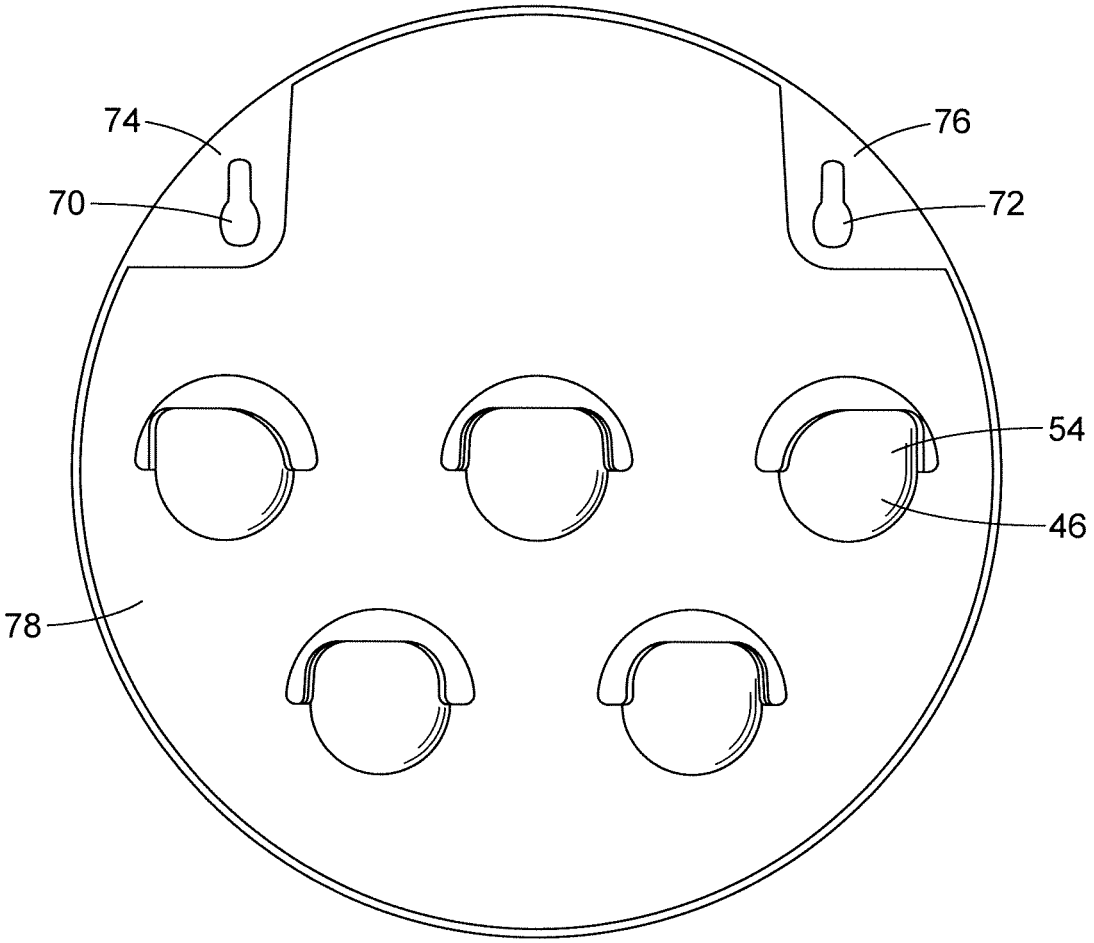
FIG. 12 is a rear elevational view of the hook board of FIG. 7.
Figure 13:
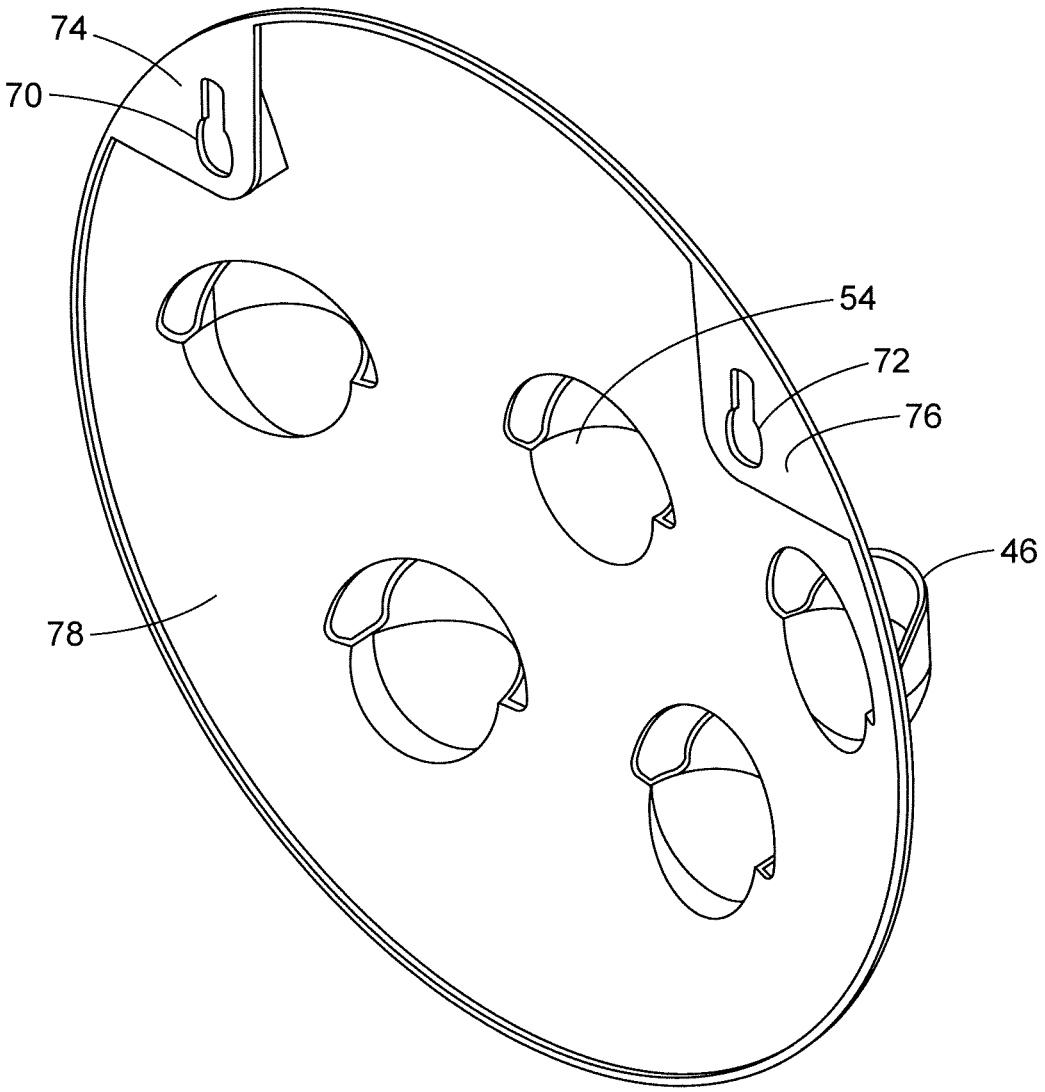
FIG. 13 is a rear perspective view of the hook board of FIG. 7.

Referring to FIGS. 10, 12 and 13, the pegs 64, 66 engage key-shaped holes or slots 70, 72 formed on rear walls or projections 74, 76 extending from rear surface 78 of the board.

Alternatively, holes 70, 72 can be used to mount the board directly onto nails or other fasteners in a wall or a door.

As previously discussed, board 44 is shown in the configuration of a basketball, but other configurations, such as a baseball, football, soccer ball, tennis ball, etc. can also be used. The hooks are preferably spaced about front wall 48 of board 44. The board can be made of plastic, wood, sturdy cardboard or any durable material.

Figure 14:
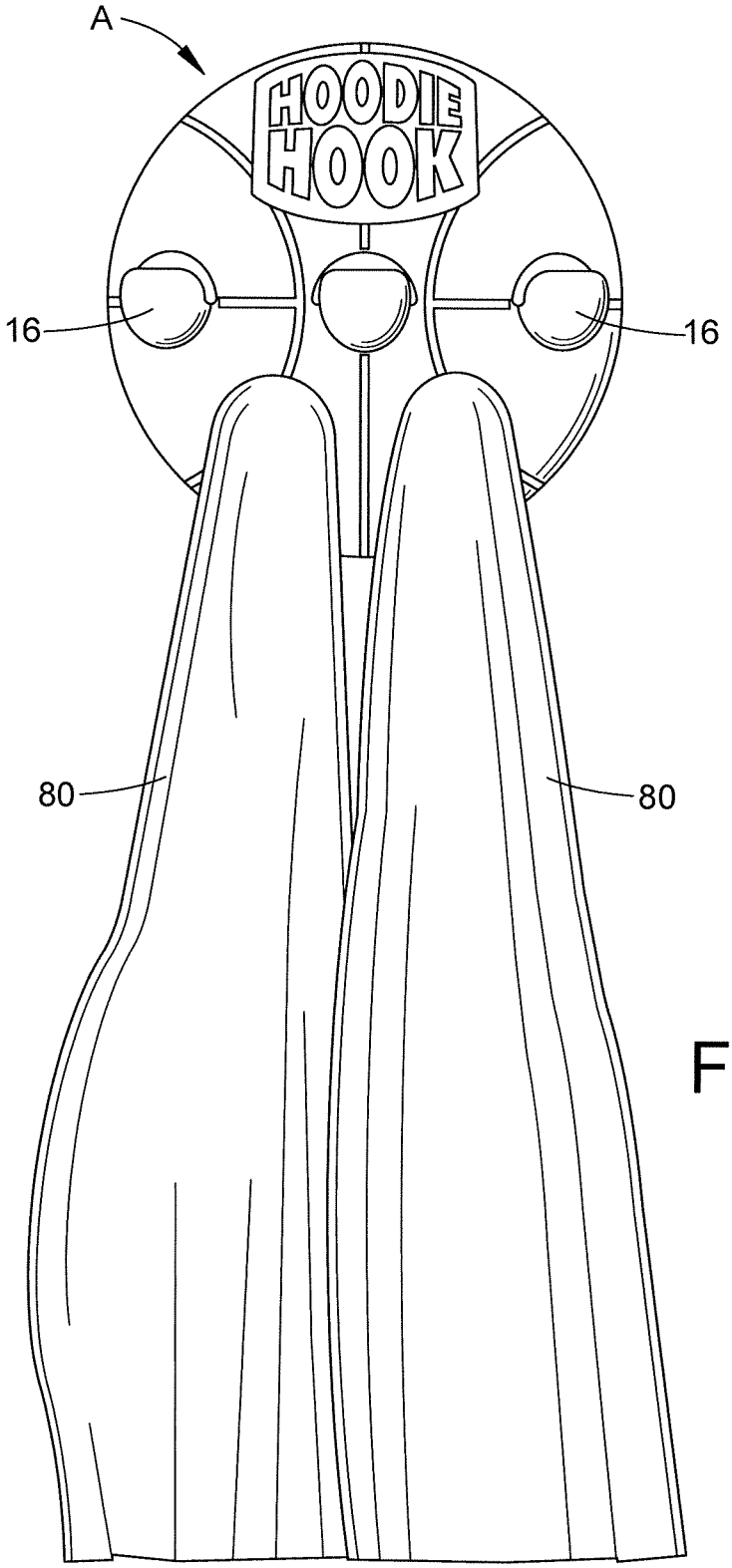
FIG. 14 is a perspective view of a hook board display arrangement.

Referring now to FIG. 14, hoodies 80 are shown hung on two of the hooks 16.

Figure 15:
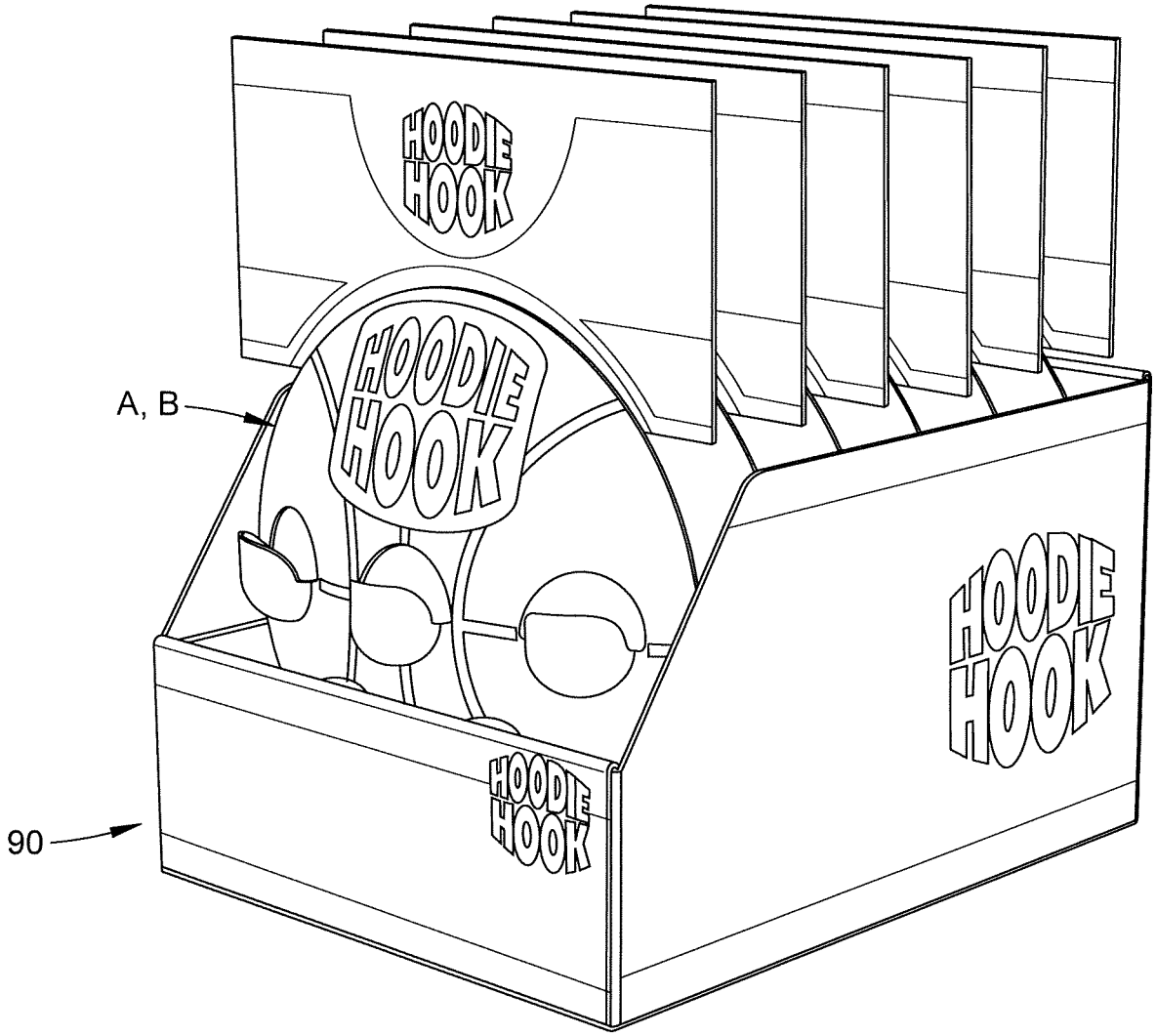
FIG. 15 is a front elevational view of a hook board with garments hanging thereon.

Referring to FIG. 15, a display unit 90 is shown as one way of marketing and selling the garment hook.

Figure 16:
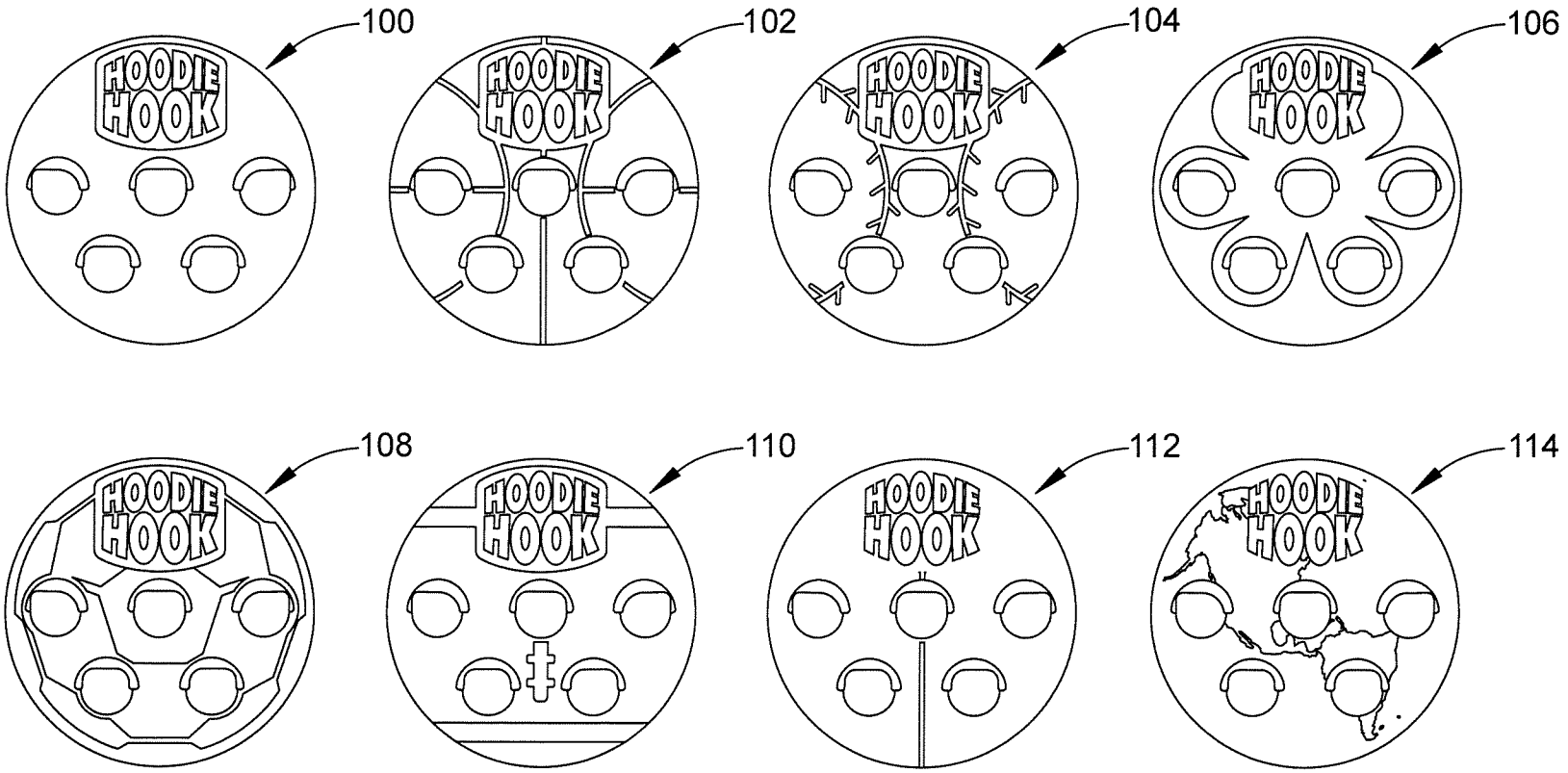
FIG. 16 illustrates top plan views of various style hook boards.

Referring now to FIG. 16, many other embodiments and shapes are contemplated for the garment hook. For example, a solid color hook 100, basketball styled hook 102, baseball styled hook 104, a flower styled hook 106, a soccer ball styled hook 108, a football styled hook 110, a ladybug styled hook 112 and a globe styled hook 114 are shown.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the disclosure and appended claims or the equivalents thereof.

The invention claimed is:

1. A hook assembly for hanging associated hoodies and garments, comprising:

a body comprising a plurality of hooks extending from said body thereby forming openings in said body behind said hooks wherein each of said plurality of hooks are integrally formed on said body;

wherein said body is circular in appearance and has a front surface which curves outwardly;

wherein each of said plurality of hooks forms a cup-shaped portion configured for receiving and retaining an associated garment;

wherein each of said plurality of hooks has a curved body with a front face formed thereon having a semi-spherical shape configured as a partial portion of a ball and wherein said semi-spherical shape of said front face extends across a width of said each of said plurality of hooks and from one side of each of said respective openings to an opposite side of each of said respective openings, wherein each of said hooks has an upper edge defining a concave portion;

the upper edge extends downwardly from opposite sides of said concave portion to define convex side portions which are formed generally perpendicular to said concave portion for receiving and retaining associated hoods and garments; wherein said convex side portions extend substantially along a height of said hook of at least one third of the height of said hook;

wherein said hooks are formed in two rows, wherein a first row comprises a plurality of hooks and said second row comprises a plurality of hooks, wherein hooks in said first row are offset from hooks in said second row; and at least one mounting arm which is mounted to a rear portion of said body.

2. The hook assembly of claim 1, wherein said body is formed of plastic.

3. The hook assembly of claim 1, wherein said body and said plurality of hooks are integrally formed of one piece.

4. The hook assembly of claim 1, wherein said body comprises grooves extending across said front wall of said body.

5. The hook assembly of claim 1, wherein said body is configured to have the appearance of one of the following: a baseball, a basketball, a football and a soccer ball.

6. The hook assembly of claim 1, wherein said body is configured to have the appearance of one of the following: a ladybug, a globe, or a flower.

7. The hook assembly of claim 1, wherein said at least one mounting arm retractably extends into and protrudes from a slot formed in a rear wall of said body.

8. The hook assembly of claim 1, wherein said at least one mounting arms comprises an inverted u-shaped hook configured to mount said body to an associated door.

9. The hook assembly of claim 1, wherein said at least one mounting arm comprises a pair of mounting arms.

10. The hook assembly of claim 9, wherein said body comprises a pair of openings form in a rear wall of said body for receiving said pair of mounting arms.

11. The hook assembly of claim 10, wherein said openings in said rear wall are substantially key-shaped.

12. The hook assembly of claim 11, wherein said mounting arms each comprise a pair of pegs for inserting into one of said openings in rear wall of said body.

13. The hook assembly of claim 1, wherein said plurality of hooks comprises five hooks spaced about a front wall of said body.

14. A hook assembly for hanging associated hooded jackets and garments, comprising:

a body comprising a plurality of hooks; each of said plurality of hooks are integrally formed on said body;

wherein each of said plurality of hooks form a cup-shaped portion and an opening in said body behind each of said hooks configured for receiving and retaining an associated garment, wherein each of said plurality of hooks has a curved body which has a front face having a semi spherical shape configured as a partial portion of a ball and wherein said semi-spherical shape of said front face has an upper end which extends across a width of each of said plurality of hooks and from one side to an opposite side of said opening behind each of said plurality of said hooks;

wherein said hooks each have an upper edge defining a concave portion;

the upper edge extends downwardly from opposite sides of said concave portion defining convex side portions which are formed generally perpendicular to said concave portion for receiving and retaining said associated hooded jackets and garments;

wherein said convex side portions extend substantially along a height of said hook of at least one third of the entire height of said hook;

wherein said body is configured to have a circular perimeter and has a front face which curves outwardly; and wherein each of said plurality of hooks protrudes outwardly from said front wall thereby forming a cavity for hanging said associated garments on each of said plurality of hooks, and wherein said hooks are formed in two rows, wherein a first row comprises a plurality of hooks and a second row comprises a plurality of hooks and wherein said hooks in said first row are offset from said hooks in said second row.

* * * * *